US007967651B2

(12) United States Patent
Koulouris

(10) Patent No.: US 7,967,651 B2
(45) Date of Patent: Jun. 28, 2011

(54) DEPLOYABLE RESCUE APPARATUS

(76) Inventor: John Christos Koulouris, Mountain View, CA (US)

( * ) Notice: Subject to any disclaimer, the term of this patent is extended or adjusted under 35 U.S.C. 154(b) by 0 days.

(21) Appl. No.: 12/371,624

(22) Filed: Feb. 16, 2009

(65) Prior Publication Data

US 2010/0210157 A1 Aug. 19, 2010

(51) Int. Cl.
*B63C 9/00* (2006.01)

(52) U.S. Cl. ..... 441/80; 441/81

(58) Field of Classification Search ..... 441/13, 441/40, 41, 42, 80, 83, 81, 84; 182/136, 182/189, 190; 362/234
See application file for complete search history.

(56) References Cited

U.S. PATENT DOCUMENTS

| | | | | |
|---|---|---|---|---|
| 1,184,325 | A * | 5/1916 | Coxey | 441/80 |
| 1,727,902 | A * | 9/1929 | Reno | 441/80 |
| 4,063,323 | A * | 12/1977 | Salvarezza | 441/80 |
| 4,138,077 | A | 2/1979 | Okumura | |
| 4,297,757 | A | 11/1981 | Palemon Camu | |
| 4,540,372 | A | 9/1985 | Mauck | |
| 4,690,650 | A | 9/1987 | Bell | |
| 5,374,211 | A * | 12/1994 | Imazato | 441/80 |
| 7,063,582 | B2 * | 6/2006 | Boujon | 441/40 |
| 7,314,398 | B2 | 1/2008 | Parrott et al. | |
| 2009/0191776 | A1 * | 7/2009 | Ding | 441/80 |

* cited by examiner

*Primary Examiner* — Lars A Olson
(74) *Attorney, Agent, or Firm* — Ash Tankha; Lipton, Weinberger & Husick

(57) ABSTRACT

Disclosed herein is a deployable apparatus and method for rescuing persons and animals from a water surface. The deployable apparatus comprises a buoyant support structure and multiple rescue units. The rescue units are detachably attached to the buoyant support structure for securing and supporting the rescued persons and animals. The rescue units, for example, comprise multiple undercarriage structures, buoyant longitudinal members, loop extensions, etc. The buoyant support structure with the rescue units is suspended from a height and lowered to the water surface using a cable. The undercarriage structures extend radially from the lower surface of the buoyant support structure on contacting the water surface. The buoyant longitudinal members are projected outwardly from the buoyant support structure in a projectile towards the persons and animals to be rescued to allow the persons and animals to grasp the longitudinal members and be drawn to the buoyant support structure.

24 Claims, 9 Drawing Sheets

DEPLOYABLE RESCUE APPARATUS

BACKGROUND

This invention, in general, relates to a rescue apparatus. More particularly, this invention relates to a deployable apparatus for rescuing persons and animals on a water surface.

It is often difficult to rescue persons involved in an accident at sea from the water using a rescue boat or other rescue devices. Lifting persons from the water and placing them in the rescue boat is difficult. Conventional rescue methods involving use of ropes ladders, etc., lowered, for example, from a helicopter, and floatation devices that generally take relatively long time to deploy and maneuver may not be very effective. People need to be rescued as quickly as possible, since their bodies cool down rapidly when submerged in water. Moreover, when the water is at a low temperature, people may suffer from hypothermia, possibly resulting in death. Furthermore, conventional rescue devices used in rescue operations may be able to rescue only a limited number of people. When a large number of people need to be rescued, multiple conventional rescue devices operated simultaneously may be required. Furthermore, conventional rescue devices may be accessible only to people within reach from the conventional rescue device. Persons at a distance from the conventional rescue device may not be rescued quickly which may eventually result in their death.

Hence, there is an unmet need for a deployable apparatus that rescues a large number of persons and animals at different distances from the deployable apparatus simultaneously or in a relatively short period of time from a water surface.

SUMMARY OF THE INVENTION

This summary is provided to introduce a selection of concepts in a simplified form that are further described in the detailed description of the invention. This summary is not intended to identify key or essential inventive concepts of the claimed subject matter, nor is it intended for determining the scope of the claimed subject matter.

The deployable apparatus and method disclosed herein addresses the above stated need for rescuing a large number of persons and animals at different distances from the deployable apparatus simultaneously or in a relatively short period of time from a water surface. The deployable apparatus comprises a buoyant support structure and multiple rescue units. The buoyant support structure is of a predefined shape, for example, a circular shape. Multiple light bulbs are disposed along the perimeter of the buoyant support structure for illuminating the field of view of the rescue scene and of the persons and animals in the rescue scene. The buoyant support structure is suspended, lowered, and hauled using a cable. The cable branches into multiple sub-cables which balance the buoyant support structure. The lower ends of the sub-cables are attached to multiple first hooks disposed on the upper surface of the buoyant support structure. In an embodiment, the upper surface of the buoyant support structure is divided into multiple compartments. Multiple second hooks are disposed along the inner edges of the compartments. Multiple leg supports are attached to the lower surface of the buoyant support structure for supporting the buoyant support structure.

The rescue units are detachably attached to the buoyant support structure for supporting the persons and animals. The rescue units, for example, comprise multiple undercarriage structures, multiple buoyant longitudinal members, and multiple loop extensions. The undercarriage structures are positioned on the lower surface of the buoyant support structure. Each of the undercarriage structures comprises a framework enclosing a perforated casing. The undercarriage structures extend radially from the lower surface of the buoyant support structure on contacting a water surface. In an embodiment, the undercarriages structures are detachably attached to the buoyant support structure and are self-powered, for example by a battery and propeller system and maneuverable by a person to reach and rescue persons and animals in the vicinity of the rescue scene. The undercarriage structures are powered by an outboard marine motor with a propeller system, and a guidance control system for allowing the undercarriage structures to be controlled and maneuvered in the vicinity of a rescue scene for reaching persons and animals floating on the water surface.

Each of the undercarriage structures defines an elongated cylinder. The buoyant support structure defines multiple fixed, radially arrayed elongated pistons. At least one of the elongated pistons corresponds to each one of the elongated cylinder. Each of the elongated pistons defines a first end and a second end. The first end of each of the elongated pistons is attached to the buoyant support structure proximal to a center of the lower surface of the buoyant support structure. The elongated pistons are arrayed radially about the lower surface of the buoyant support structure. Each of the undercarriage structures has a stored position and an extended position. Each elongated cylinder is in slideable engagement with the second end of one of the elongated pistons when the undercarriage structures are in the stored position. Each one of the elongated cylinder is disengaged from the second end of one of the elongated pistons and the undercarriage structures are disengaged from the buoyant support structure when the undercarriage structures are in the extended position. One of the elongated pistons and the elongated cylinder are moveable between the stored position and the extended position.

The undercarriage structures are moved from a stored position to an extended position by pressurized gas. The second end of each of the elongated pistons engages with the elongated cylinder of each of the undercarriage structures when the undercarriage structures are in a stored position. When the deployable apparatus is in use and in the water, the pressurized gas presses upon the elongated pistons and walls of the elongated cylinder. The resulting force moves the undercarriage structures from a stored position in engagement with the buoyant support structure to an extended position disengaged from the buoyant support structure. The pressurized gas is supplied by compressed air from one or more pressure vessels. Alternatively, the pressurized gas is supplied by combustion, for example, by a small combustible charge. The water in which the undercarriage structures are immersed dampens and slows the motion of the undercarriage structures to avoid injury to persons and animals in the water when the undercarriage structures are extended.

The buoyant longitudinal members are detachably attached to the upper surface of the buoyant support structure. The buoyant longitudinal members are projected outwardly from the buoyant support structure in a projectile path from the buoyant support structure towards the persons and animals to be rescued. A retractable cable is connected to each of the buoyant longitudinal members for retracting the projected buoyant longitudinal members to the buoyant support structure. In an embodiment, the retractable cable is wound around a pulley. The retractable cable retracts the buoyant longitudinal members to the buoyant support structure using the pulley. Multiple floating bulbs are attached to the upper distal ends of the buoyant longitudinal members for illuminating field of view of the rescue scene and of the persons and animals in the rescue scene.

The loop extensions are disposed along a cord positioned around perimeter of the buoyant support structure. The loop extensions, for example, comprise multiple hook and loop fasteners for allowing the persons and animals to be rescued by securing their arms to the loop extensions.

The buoyant support structure with the rescue units is lowered to the water surface using the cable from an overhead device such as a helicopter. The undercarriage structures extend from the lower surface of the suspended buoyant support structure on contacting the water surface. The undercarriage structures serve to hold and secure persons and animals rescued from the water and allow them to stay above the water surface. Persons and animals may also secure themselves to the projected buoyant longitudinal members. The projected buoyant longitudinal members are then retracted to the buoyant support structure using the retractable cable. The retraction draws the secured persons and animals to the buoyant support structure. The persons and animals in the rescue units of the buoyant support structure are then hauled from the water surface using the cable to the device from which the deployable apparatus was lowered to the water surface.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and instrumentalities disclosed herein.

DETAILED DESCRIPTION OF THE INVENTION

Figure 1:
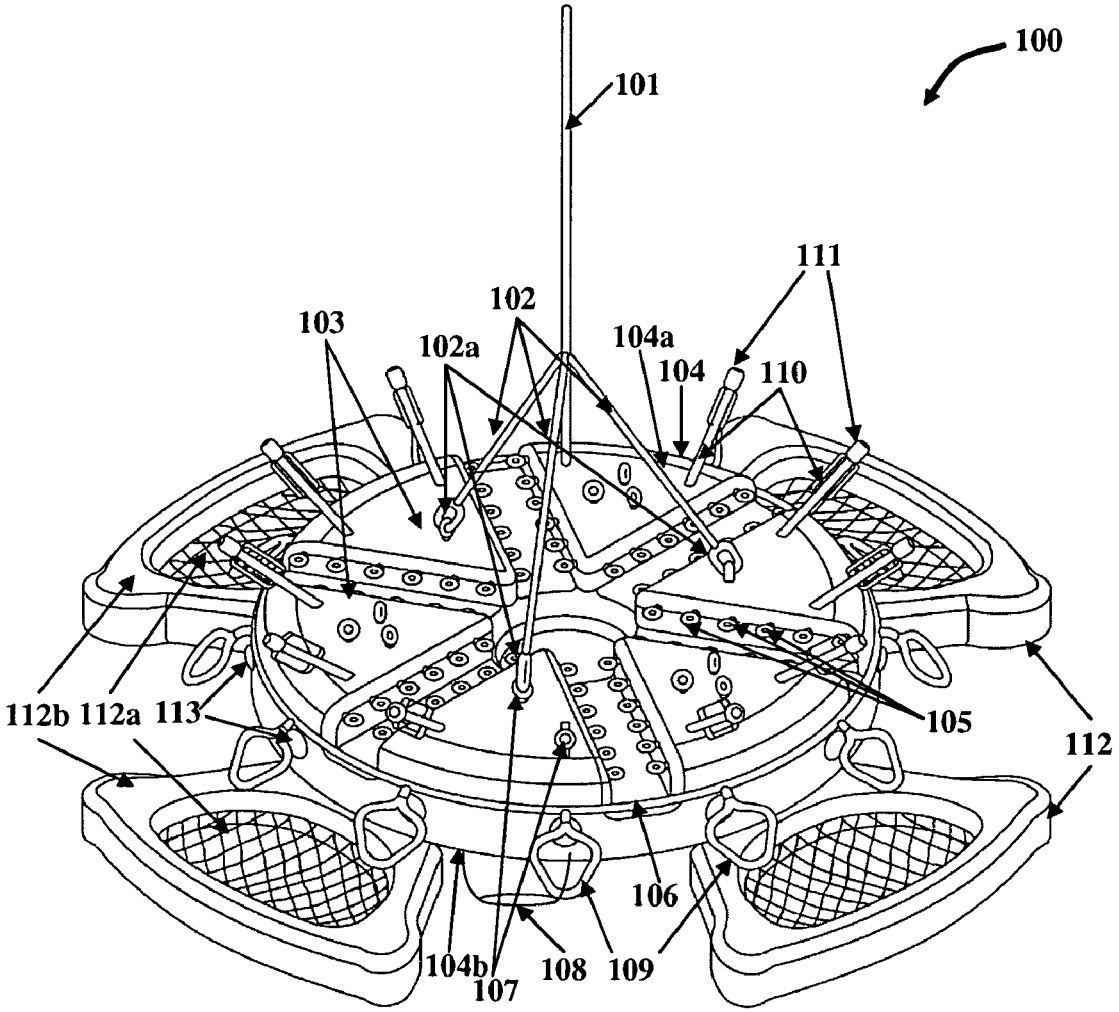
FIG. 1 illustrates a deployable apparatus for rescuing persons and animals.

FIG. 1 illustrates a deployable apparatus 100 for rescuing persons and animals from a water surface, for example, a lake, ocean, etc. The deployable apparatus 100 comprises a buoyant support structure 104 and multiple rescue units detachably attached to the buoyant support structure 104. The buoyant support structure 104 is of a predefined shape, for example, a generally circular shape. The buoyant support structure 104 is suspended and lowered from a height above the water surface to the water surface using a cable 101 from an overhead device such as a helicopter. The buoyant support structure 104 is also hauled vertical up or along the surface of the water surface using the cable 101. The cable 101 branches into multiple sub-cables 102. For example, as illustrated in FIG. 1, the cable 101 branches into three sub-cables 102. The sub-cables 102 balance the buoyant support structure 104 in a substantially horizontal position on the surface of the water 505. The lower ends 102*a* of the sub-cables 102 are attached to multiple first hooks 107 disposed on the upper surface 104*a* of the buoyant support structure 104.

In an embodiment, the upper surface 104*a* of the buoyant support structure 104 is divided into multiple compartments 103. The compartments 103 may be of different shapes, for example, triangular, circular, etc. Each of the compartments 103 comprises multiple second hooks 105 disposed along the inner edges of the compartments 103. The second hooks 105, for example, are flexible rubber handle supports or retractable line extensions to which survivors may hold onto while waiting to be hauled up to the helicopter or other device. The deployable apparatus 100 further comprises multiple leg supports 108 attached to the lower surface 104*b* of the buoyant support structure 104 for supporting the buoyant support structure 104 on a substantially horizontal surface such as the ground. The leg supports 108 are used for storing the deployable apparatus 100 at an elevated position from a surface. Multiple light bulbs 113 are disposed along the perimeter of the buoyant support structure 104 for illuminating the field of view of the rescue scene and of persons and animals in the rescue scene.

The rescue units are detachably and retractably attached to the buoyant support structure 104 for supporting the persons and animals. The rescue units, for example, comprise one or more of multiple undercarriage structures 112, multiple buoyant longitudinal members 110, and multiple loop extensions 109. The buoyant longitudinal members 110 are detachably attached to the upper surface 104*a* of the buoyant support structure 104. The buoyant longitudinal members 110 are projected outwardly from the buoyant support structure 104 in a projectile path from the buoyant support structure 104 towards the persons and animals to be rescued. Multiple floating bulbs 111 are attached to upper distal ends of the buoyant longitudinal members 110 for illuminating the field of view of the rescue scene and of the persons and animals in the rescue scene. The buoyant longitudinal members 110 are attached to the buoyant support structure 104 by a retractable cable (not shown). The retractable cable is wound around a pulley (not shown) post retraction.

The loop extensions 109 are disposed along a cord 106 that is positioned around the perimeter of the buoyant support structure 104. The loop extensions 109, for example, comprise multiple hook and loop fasteners for allowing the persons and animals rescued to hold on to the loop extensions 109 with their arms. The rescue units are made of marine resistant and structurally sound materials. The rescue units are also made of a water resistant material, for example, triazabicyclodecene (TBD), or other marine resistant materials. The persons and animals are rescued by using the rescue units of the deployable apparatus 100, or by the extended undercarriage structures 112.

The undercarriage structures 112 are detachably positioned on the lower surface 104*b* of the buoyant support structure 104. In an embodiment, each of the undercarriage structures 112 comprises a framework 112*b* enclosing a perforated casing 112*a*. The perforated casing 112*a*, for example, is a net positioned at the water level surface for holding and securing the rescued persons and animals above the water surface.

In an embodiment, the undercarriage structures 112 are buoyant structures and may be detachably attached to the buoyant support structure 104. The undercarriage structure 112 may be powered by an outboard marine motor with a propeller system, and guidance control system for allowing the undercarriage structures 112 to be controlled and maneuvered by a rescue team member, in the vicinity of a rescue scene to reach and rescue persons and animals from the water surface. The undercarriage structures 112 hold and secure survivors from the water 505 and return to dock with the buoyant support structure 104. In an embodiment, the self-powered and propelled undercarriage structures 112 may, for example, be remotely controlled by a person from the device that lowers the deployable apparatus 100 from the helicopter or other device to the surface of the water 505, or remotely controlled by a rescue team member at the water surface.

In another embodiment, each of the undercarriage structures 112 may define at least one elongated cylinder 202. A lower surface 104*b* of the buoyant support structure 104 defines multiple rod-shaped elongated pistons 201 attached to the buoyant support structure 104 as exemplarily illustrated in FIG. 2. At least one of the elongated pistons 201 corresponds to each elongated cylinder 202. Each of the elongated pistons 201 defines a first end 201*a* and a second end 201*b*. The first end 201*a* of each of the elongated pistons 201 is attached to the buoyant support structure 104 proximal to a center of the lower surface 104*b* of the buoyant support structure 104. The elongated pistons 201 are arrayed radially about the lower surface 104*b* of the buoyant support structure 104. The elongated pistons 201 are fixed with respect to the buoyant support structure 104.

Figure 2:
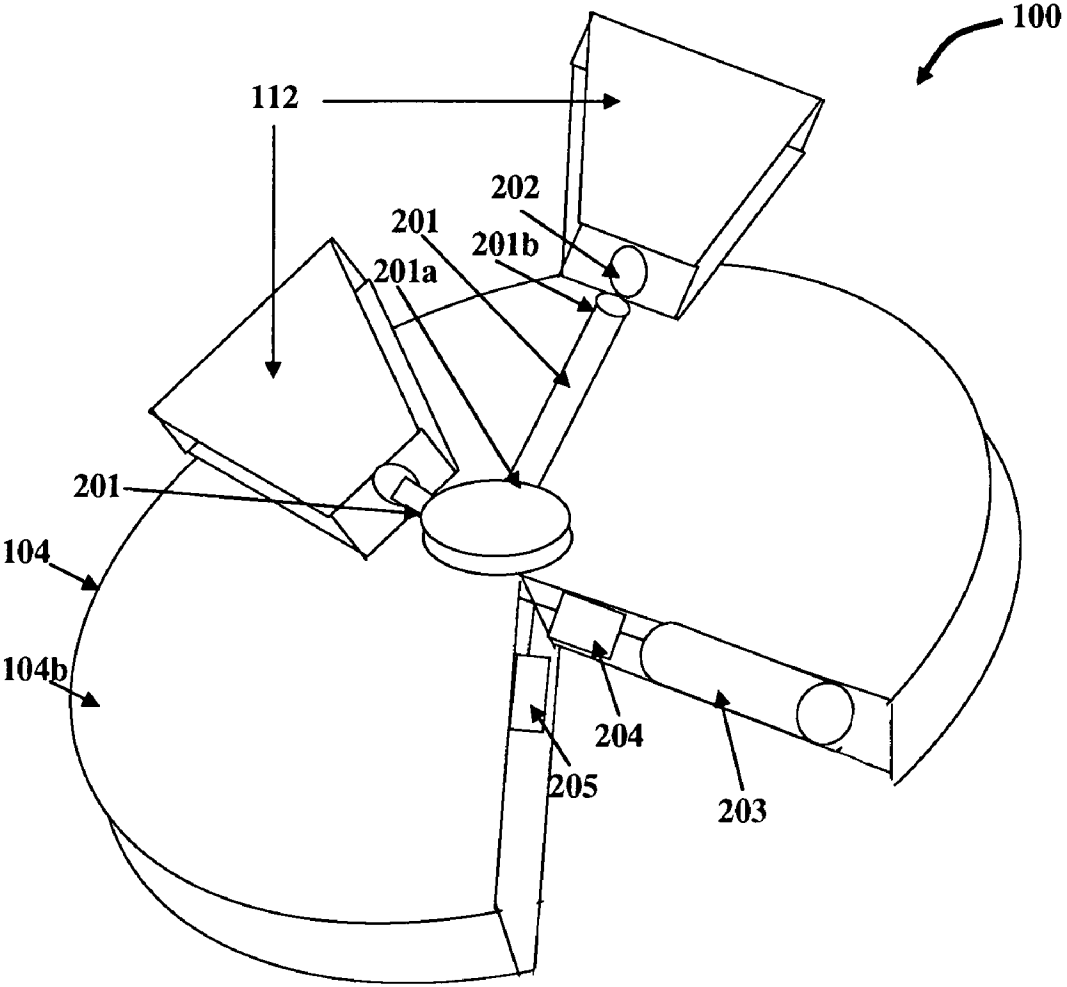
FIG. 2 exemplarily illustrates the stored position and the extended position of undercarriage structures on a lower surface of the buoyant support structure of the deployable apparatus.

Each of the undercarriage structures 112 has a stored position and an extended position. Each elongated cylinder 202 of each of the undercarriage structures 112 may slideably engage one of multiple elongated pistons 201. The elongated cylinder 202 is in slideable engagement with the second end 201*b* of one of the elongated pistons 201 when the undercarriage structures 112 are in the stored position. Each one of the elongated cylinder 202 is disengaged from the second end 201*b* of one of the elongated pistons 201 and the undercarriage structures 112 are disengaged from the buoyant support structure 104 when the undercarriage structures 112 are in the extended position. One of the elongated pistons 201 and the elongated cylinder 202 are moveable between the stored position and the extended position. FIG. 2 illustrates one of the undercarriage structures 112 in the stored position and another one of the undercarriage structures 112 in the extended position on the lower surface 104*b* of the buoyant support structure 104 of the deployable apparatus 100.

Figure 3:
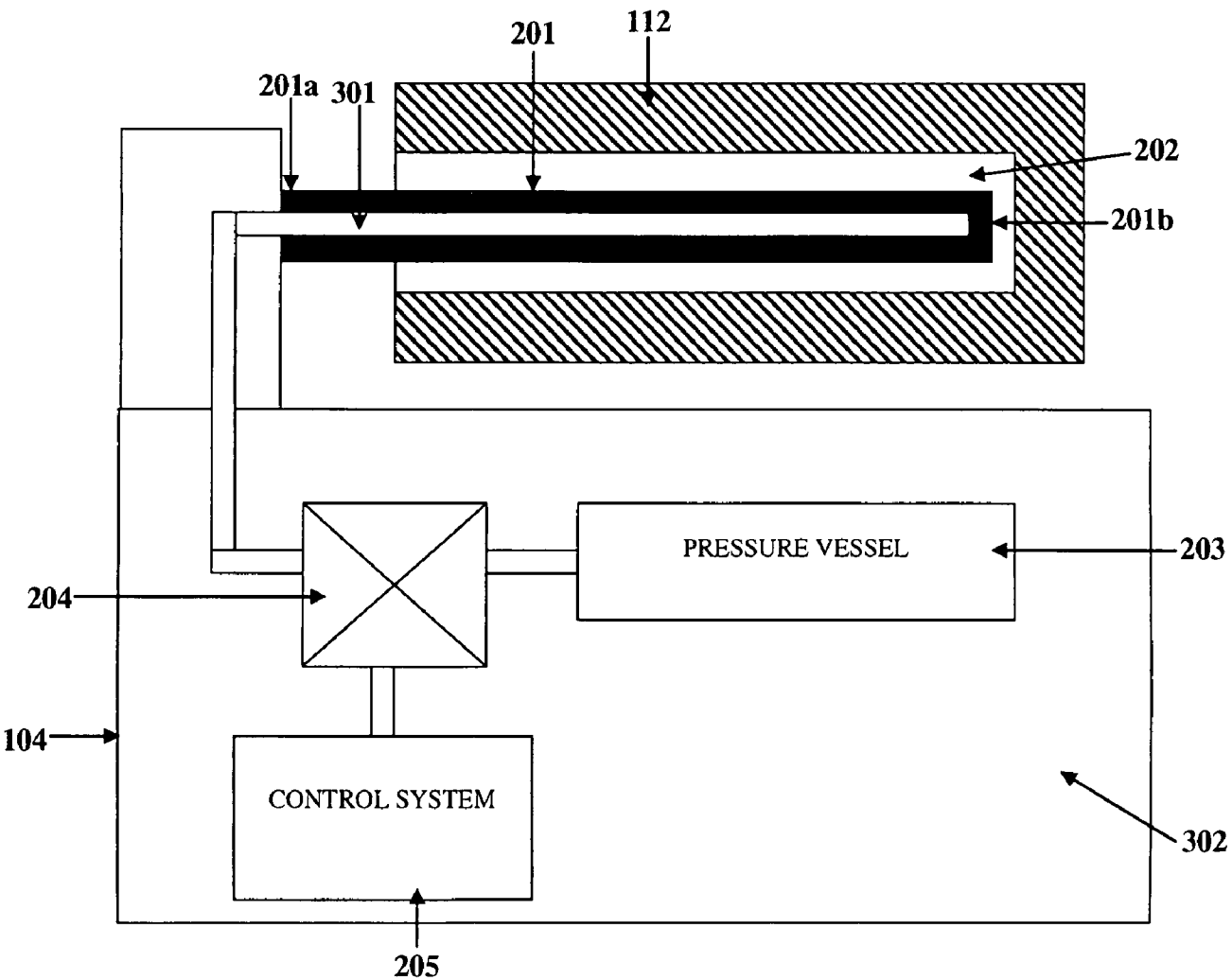
FIGS. 3-4 exemplarily illustrate cross sectional views of one of the undercarriage structures and the buoyant support structure.
Figure 4:
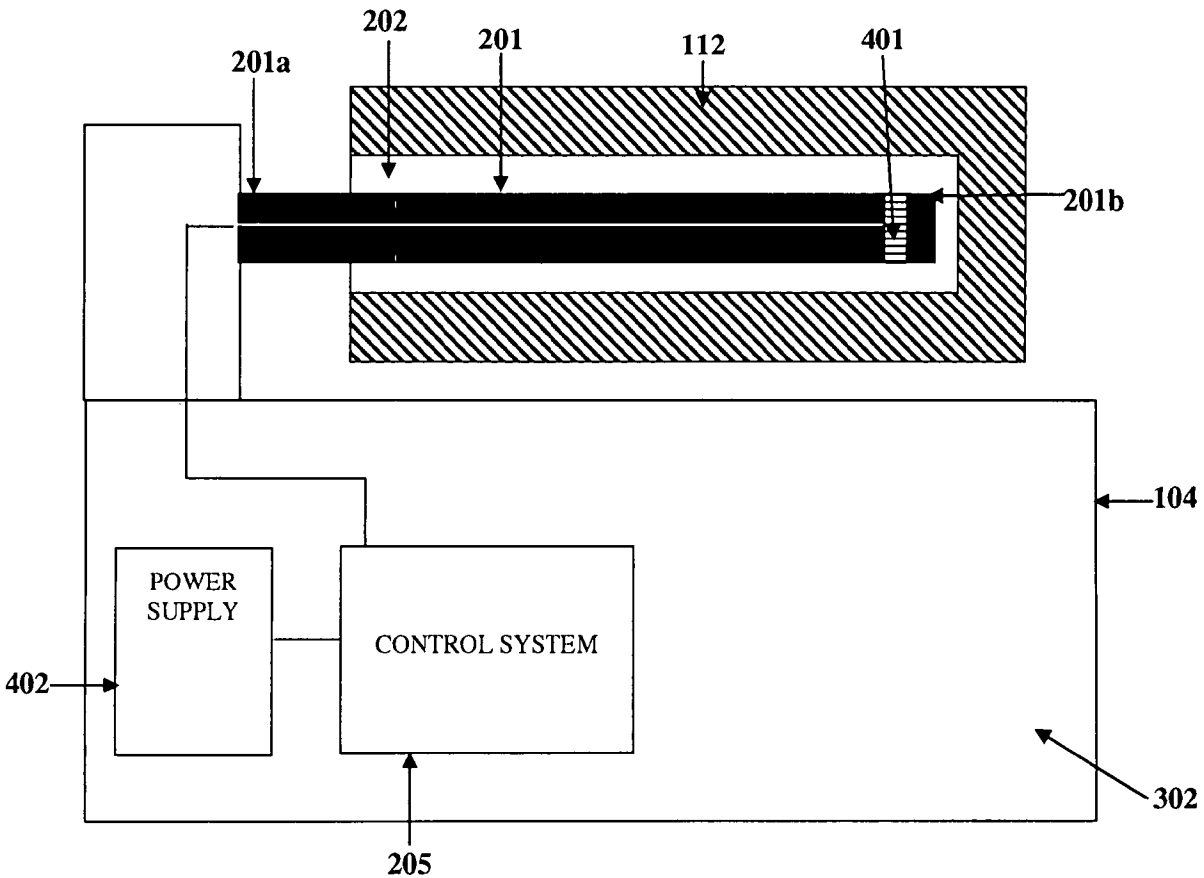

The buoyant support structure 104 defines a compartment 302 as exemplarily illustrated in FIG. 3 and FIG. 4 and a means to introduce pressurized gas into the elongated cylinder 202 adjacent to the second end 201*b* of each of the elongated pistons 201 when the buoyant support structure 104 is immersed in water 505. The means to introduce the pressurized gas comprises one or more pressure vessels 203 contained within the compartment 302 of the buoyant support structure 104, compressed air piping 301, a valve 204, and a control system 205 as exemplarily illustrated in FIG. 2 and FIG. 3. The pressure vessels 203 contain compressed air. The compressed air piping 301 is in fluid communication with one or more of the pressure vessels 203 and the elongated cylinder 202. The valve 204 is configured to control flow of the compressed air in the compressed air piping 301 from one or more of the pressure vessels 203 to the elongated cylinder 202. The control system 205 is operably connected to the valve 204. The control system 205 is configured to instruct valve 204 to allow compressed air to flow from one or more of the pressure vessels 203 to the elongated cylinder 202 only when the lower surface 104*b* of the buoyant support structure 104 is immersed in the water 505.

Figure 5:
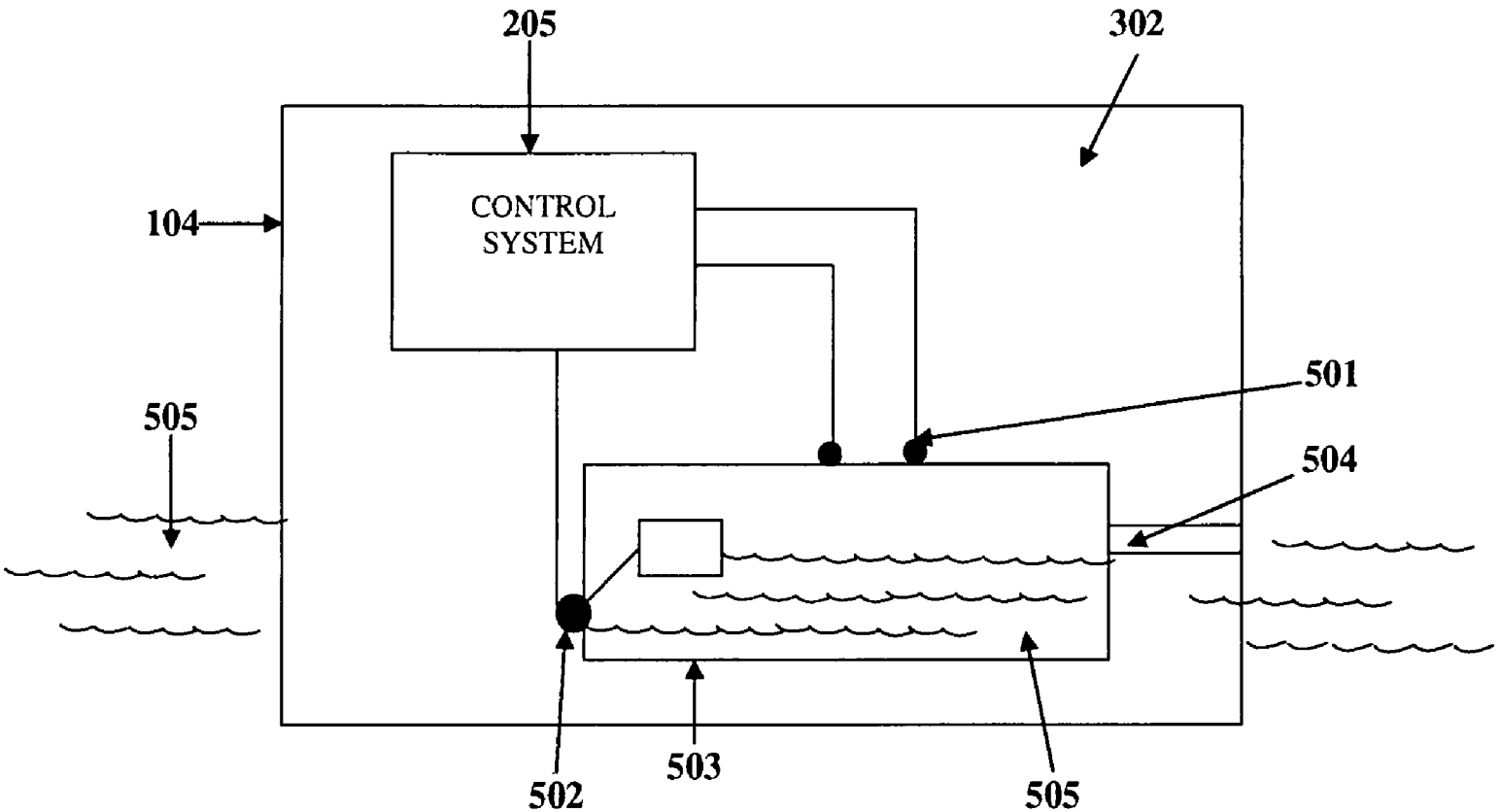
FIG. 5 exemplarily illustrates a cross sectional view of the buoyant support structure comprising a floodable chamber.

The means to introduce pressurized gas into the elongated cylinder 202 further comprises a combustible charge 401 contained within the elongated cylinder 202, and an electrical means for igniting the combustible charge 401 as exemplarily illustrated in FIG. 4. The electrical means, for example, is a power supply 402 operably connected to the control system 205 for igniting the combustible charge 401. The control system 205 comprises a floodable chamber 503 defined by a chamber of the buoyant support structure 104 as exemplarily illustrated in FIG. 5. The floodable chamber 503 comprises a float switch 502 and a conduction switch 501 contained within the chamber and operably connected to the valve 204. The conduction switch 501 is configured to detect presence of water 505. The control system 205 is configured to activate the valve 204 only when the float switch 502 and the conduction switch 501 indicate a presence of water 505 at the same time.

When the elongated pistons 201 are engaged to the elongated cylinder 202 of each one of the undercarriage structures 112, the undercarriage structures 112 may be retained in a stored position. When the deployable apparatus 100 is in use at a rescue scene and after the deployable apparatus 100 reaches the water surface, pressurized gas may be introduced into a confined space defined by the elongated cylinder 202 and the elongated pistons 201. The pressurized gas causes the elongated cylinder 202, which is fixed with respect to the undercarriage structures 112, to move with respect to the elongated pistons 201, which is fixed with respect to the buoyant support structure 104. The force imparted by the pressurized gas causes the undercarriage structures 112 to move from the stored position on the lower surface 104*b* of the buoyant support structure 104 to an extended position on the buoyant support structure 104.

The undercarriage structures 112 move from the stored position to the extended position only after the deployable apparatus 100 is in the water 505. When the deployable apparatus 100 is first placed in the water 505 and while the undercarriage structures 112 are still in the stored position, the undercarriage structures 112 are submerged. The water 505 surrounding the submerged undercarriage structures 112 dampens and slows the motion of the undercarriage structures 112 with respect to the buoyant support structure 104, thereby preventing injury to persons and animals in the vicinity of the buoyant support structure 104.

One or more pressure vessels 203 may store compressed air. The compressed air may be the source of the pressurized gas that moves the elongated cylinder 202 with respect to the elongated pistons 201. The pressure vessels 203 may be contained within the one or more compartments 302 of the buoyant support structure 104 as exemplarily illustrated in FIG. 3. The valve 204 may selectably control the application of pressure to the elongated pistons 201 and elongated cylinder 202 of the undercarriage structures 112. The valve 204 may be operated by a control system 205. The control system 205 may be operated manually by a person aboard the buoyant support structure 104 or may be operated remotely by radio control, for example, by a crew member of a rescue helicopter. Alternatively, a floodable chamber 503 may be provided with a float switch 502 and a conduction switch 501 as exemplarily illustrated in FIG. 5. When the deployable apparatus 100 enters the water 505 from the water surface, the floodable chamber 503 may flood in a controlled manner through metered orifices 504 in the floodable chamber 503. The water 505 entering the chamber causes the float switch 502 to trip. The water 505 in the floodable chamber 503 may also trigger the conduction switch 501. When both the float switch 502 and conduction switch 501 are triggered, the valve 204 is opened electrically, causing the undercarriage structures 112 to deploy by extension.

The pressure vessels 203 containing compressed air also may be used to power the projection of the buoyant longitudinal members 110, the floatation bulbs 111, and the light bulbs 113. Each of the buoyant longitudinal members 110 may rest in a cylindrical receptacle defined by a buoyant support member. The cylindrical receptacle defines a second cylinder and the buoyant support member defines a second piston. On instruction from the control system 205, the compressed air may be introduced into the second cylinder and ejects the buoyant longitudinal members 110 from the second cylinder, causing the buoyant longitudinal members 110 to project in the direction of the persons and animals to be rescued and deployment of the retractable cable attached to each of the buoyant longitudinal members 110.

As an alternative to the use of compressed air, the control system 205 may fire a small combustible charge 401, such as an explosive, to generate the pressurized gas to extend and deploy the undercarriage structures 112. A power supply 402 may be used to ignite the combustible charge 401 as exemplarily illustrated in FIG. 4. The small combustible charge 401 may be fired either in a centrally located combustion chamber and the products of combustion may be transferred by the compressed air piping 301 through the stationary elongated pistons 201 to the elongated cylinder 202. Alternatively, separate charges may be placed in each elongated cylinder 202 and fired electrically. Small combustible charges 401 also may be used to power the projection of the buoyant longitudinal members 110.

Figure 6:
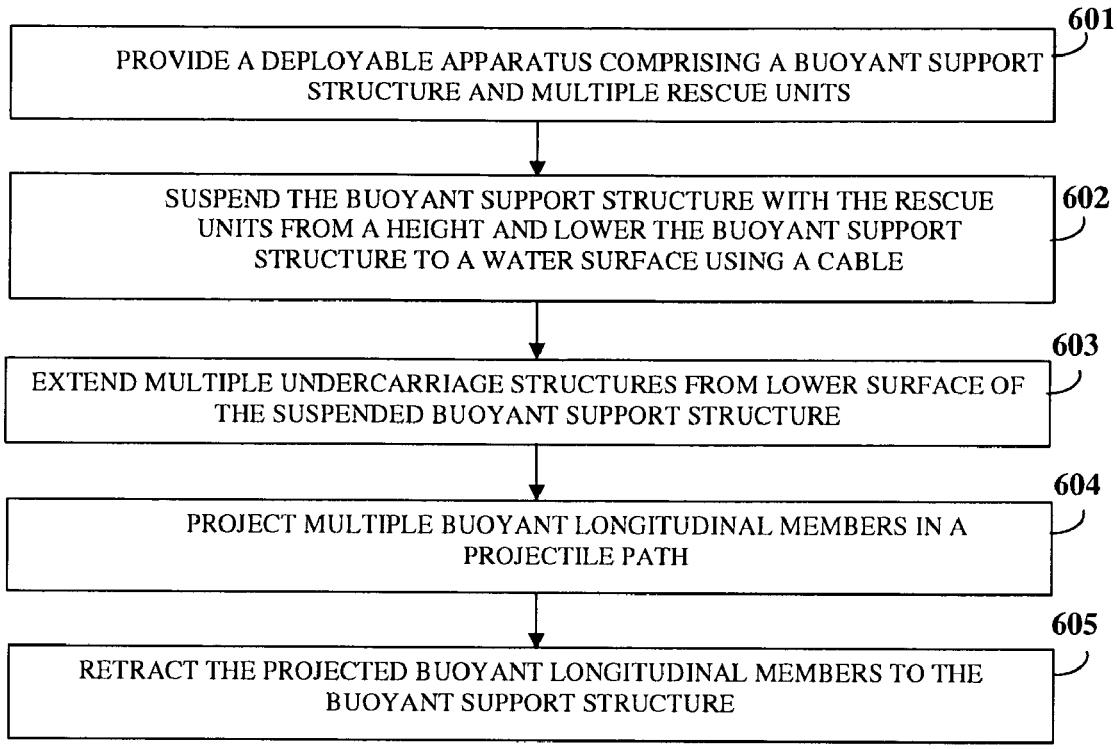
FIG. 6 illustrates a method of rescuing persons and animals.

FIG. 6 illustrates a method of rescuing persons and animals. The persons and animals may be in a body of water 505, for example, a sea. A deployable apparatus 100 is provided 601. The deployable apparatus 100 comprising a buoyant support structure 104 of a predefined shape and multiple rescue units. The rescue units are detachably attached to the buoyant support structure 104 for holding and securing the persons and animals rescued. The rescue units comprise multiple second hooks 105, loop extensions 109, multiple undercarriage structures 112 and multiple buoyant longitudinal members 110 as explained in the detailed description of FIG. 1. The undercarriage structures 112 comprise a framework 112*b* enclosing a perforated casing 112*a*. The perforated casing 112*a* is positioned at the water surface. The buoyant longitudinal members 110 are detachably attached to the upper surface 104*a* of the buoyant support structure 104. In an embodiment, the self-powered and self-propelled undercarriage structures 112 are detachably connected to the buoyant support structure 104 and may also be extended to rescue persons and animals in the vicinity of the rescue scene.

Figure 7A:
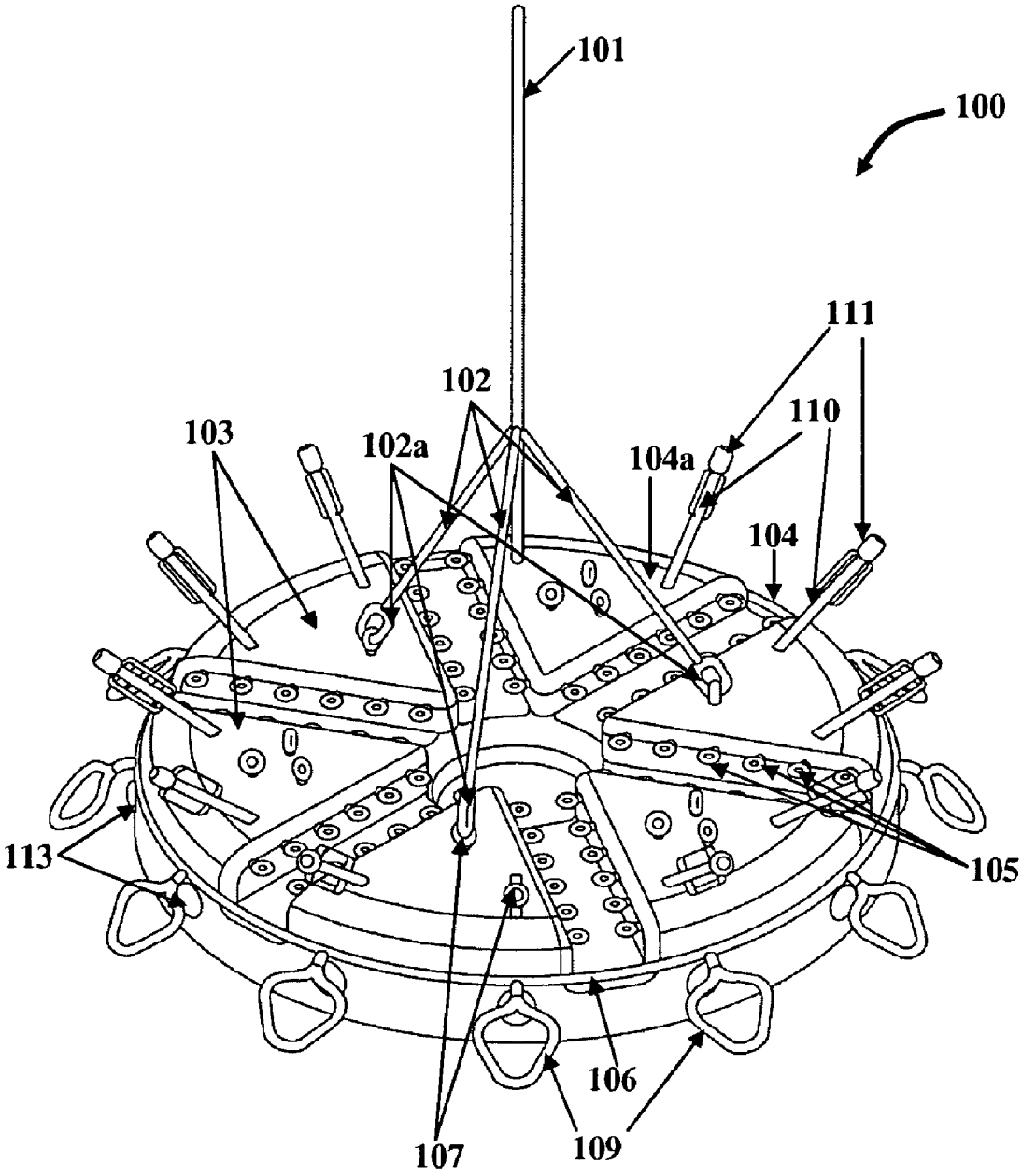
FIG. 7A exemplarily illustrates a deployable apparatus prior to extension of the undercarriage structures.

The buoyant support structure 104 with the rescue units is suspended 602 and lowered from a height above the water surface to the water surface using a cable 101 from a device such as a helicopter. The buoyant support structure 104 prior to extension of the undercarriage structures 112 is illustrated in FIG. 7A. The undercarriage structures 112 extend 603 radially from the lower surface 104*b* of the buoyant support structure 104 on contacting the water surface. The extension of the undercarriage structures 112 from the lower surface 104*b* of the buoyant support structure 104 is explained in the detailed description of FIGS. 1-5. Multiple sensors may be used to determine the contact of the buoyant support structure 104 with the water surface. An operator may also visually determine whether the buoyant support structure 104 has contacted the water surface, after which the operator activates and extends the undercarriage structures 112 on the water surface. The perforated casing 112*a* of the extended undercarriage structures 112 secures and holds persons and animals rescued from the water 505 within the framework 112*b* of the undercarriage structures 112. In an embodiment, the undercarriage structures 112 are detachably attached to the buoyant support structure 104 and may be powered by an outboard marine motor with a propulsion system, and a guidance control system. The undercarriage structures 112 can, for example, be controlled and maneuvered in the vicinity of the rescue scene to rescue persons and animals from the water surface by a person from the rescue team, remotely controlled by a person from the device that lowered the deployable apparatus 100, or remotely controlled by a rescue team member at the water surface.

Figure 7B:
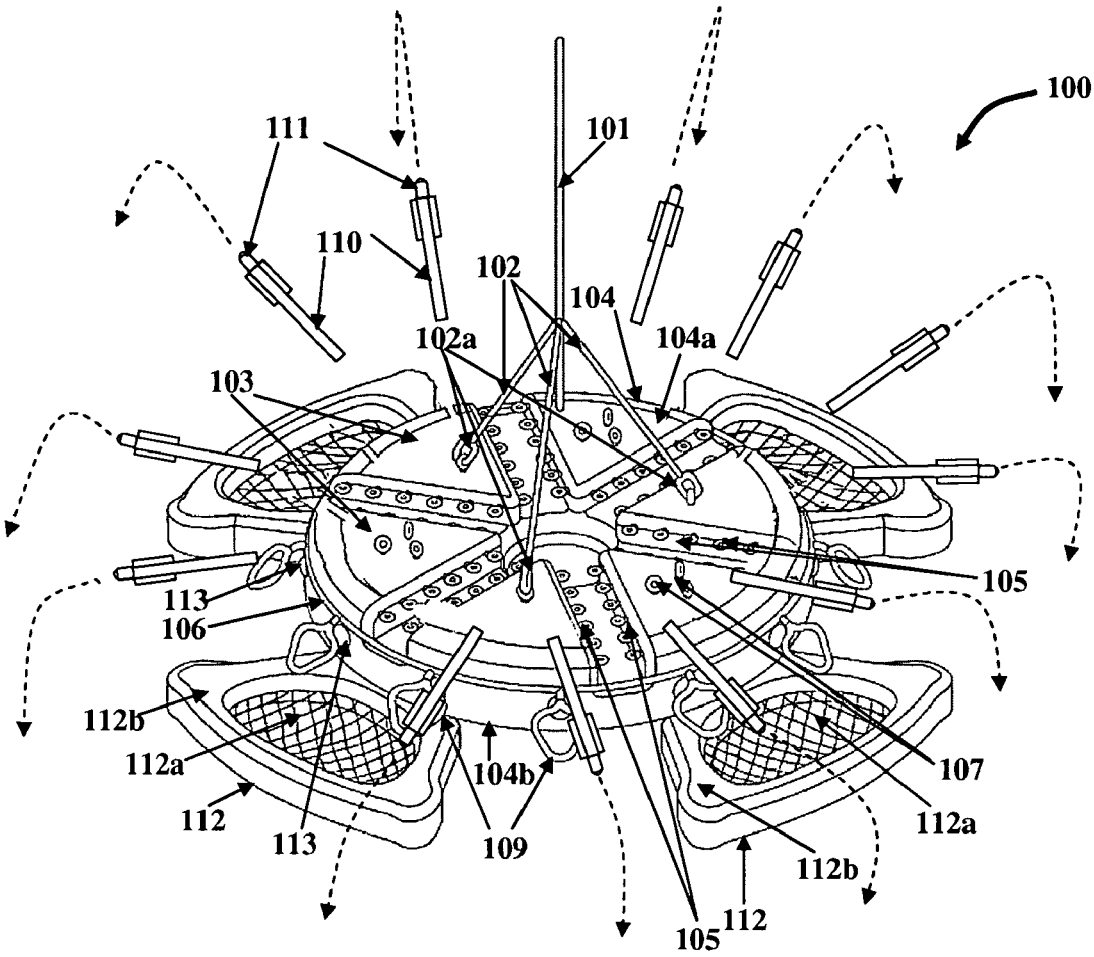
FIG. 7B exemplarily illustrates projection of multiple buoyant longitudinal members from a buoyant support structure of the deployable apparatus.

The buoyant longitudinal members 110 are projected 604 in a projectile path from the buoyant support structure 104 towards the persons and animals to be rescued as exemplarily illustrated in FIG. 7B. For example, the buoyant longitudinal members 110 may be projected on the water surface at a distance of up to 40 feet from the buoyant support structure 104 for rescuing the persons and animals. The persons secure themselves to the projected buoyant longitudinal members 110 and are drawn towards and into the buoyant support structure 104 when the projected buoyant longitudinal members 110 are retracted 605 to the buoyant support structure 104 using a retractable cable connected to the buoyant longitudinal members 110. The retraction of the projected buoyant longitudinal members 110 towards the buoyant support structure 104 is exemplarily illustrated in FIG. 7C. The retractable cable retracts the projected buoyant longitudinal members 110 to the buoyant support structure 104 using a pulley. The retraction draws the secured persons and animals to the buoyant support structure 104. The retractable cable may be wound onto a pulley post retraction.

Multiple floating bulbs 111 attached to the upper distal ends of the buoyant longitudinal members 110 and multiple light bulbs 113 disposed along the perimeter of the buoyant support structure 104 illuminate the field of view of the rescue scene and of the persons and animals at the rescue scene. The floating bulbs 111 and the light bulbs 113 enhance visibility of the buoyant longitudinal members 110 and the buoyant support structure 104 to the persons and animals being rescued. Multiple loop extensions 109 are positioned along a cord 106 disposed around the perimeter of the buoyant support structure 104. The persons and animals may grasp the loop extensions 109 during the rescue. The persons and animals rescued may secure their arms to the hook and loop fasteners of the loop extensions 109. Multiple second hooks 105 are disposed along inner edges of multiple compartments 103 on the upper surface 104*a* of the buoyant support structure 104. The persons and animals to be rescued may grasp the second hooks 105 disposed along inner edges of the compartments 103 of the buoyant support structure 104 during the rescue. The persons and animals secured to the rescue units and the buoyant support structure 104 are then hauled to a safe location, for example, a helicopter or a ship using the cable 101 from the water surface.

Consider an example where a ship is wrecked by a high wave at sea. The people traveling in the ship are thrown into the frigid waters and drift away from the ship in different directions. A rescue helicopter arrives at the site for the people's rescue. An operator at the bay door of the helicopter throws the deployable apparatus 100 illustrated in FIG. 7A for rescuing the people. The operator deploys the deployable apparatus 100 by suspending and lowering the buoyant support structure 104 to the water surface using the cable 101 for rescuing the people in the sea. When the buoyant support structure 104 contacts the water surface, the undercarriage structures 112 on the lower surface 104*b* of the buoyant support structure 104 are extended as illustrated in FIG. 7B. Persons floating near the periphery of the undercarriage structures 112 are held and secured within the perforated casing 112*a* of the undercarriage structures 112. Persons and animals that may be at a distance from the shipwreck may be picked by the self-propelled undercarriage structures 112 that may be directed towards the persons to be rescued, for example, by the operator in control of the self-propelled undercarriage structures 112, by remote control of the undercarriage structures 112 by the operator on the helicopter or other device that lowered the deployable apparatus 100, or by a rescue team member at the water surface.

Figure 7C:
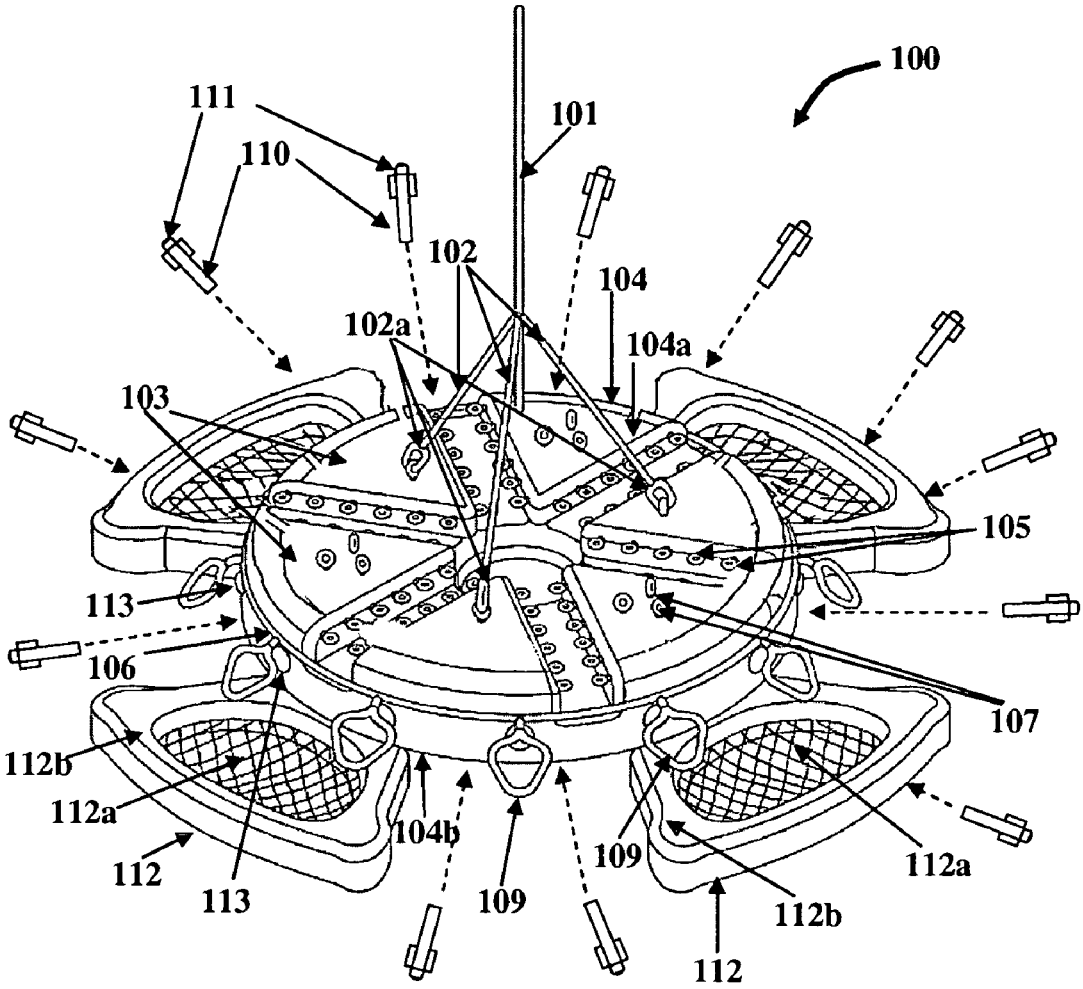
FIG. 7C exemplarily illustrates retraction of multiple buoyant longitudinal members towards the buoyant support structure.

The buoyant longitudinal members 110 are projected towards the persons and animals to be rescued, for example, about 100 feet, as illustrated in FIG. 7B. The persons and animals on the water surface grasp the buoyant longitudinal members 110. The projected buoyant longitudinal members 110 are then drawn to the buoyant support structure 104 using a retractable cable connected to the buoyant longitudinal members 110 as illustrated in FIG. 7C. The persons and animals secured to the buoyant longitudinal members 110 are drawn closer to the buoyant support structure 104 and are accommodated within the undercarriage structures 112. The persons and animals on the water surface may also grasp the loop extensions 109 and the second hooks 105 provided on the buoyant support structure 104. The operator then hauls the persons and animals secured to the buoyant support structure 104 and the rescue units from the sea to a shore, thereby rescuing them.

The foregoing examples have been provided merely for the purpose of explanation and are in no way to be construed as limiting of the present invention. While the invention has been described with reference to various embodiments, it is understood that the words, which have been used herein, are words of description and illustration, rather than words of limitation. Further, although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

I claim:

1. A deployable apparatus for rescuing persons and animals, comprising:

a buoyant support structure of a predefined shape; and a plurality of rescue units detachably attached to said buoyant support structure for supporting said persons and animals, said rescue units comprising:

a plurality of undercarriage structures positioned on a lower surface of the buoyant support structure, wherein said undercarriage structures extend and/or retract radially from said lower surface of the buoyant support structure;

a plurality of buoyant longitudinal members detachably attached to upper surface of the buoyant support structure, wherein said buoyant longitudinal members project outwardly from the buoyant support structure in a projectile path towards the persons and animals to be rescued from the buoyant support structure, and a plurality of loop extensions disposed along a cord positioned around perimeter of the buoyant support structure;

whereby the persons and animals are rescued using said rescue units of said deployable apparatus.

2. The deployable apparatus of claim 1, wherein each of the undercarriage structures defines an elongated cylinder, and wherein the buoyant support structure defines a plurality of elongated pistons, wherein at least one of said elongated pistons corresponds to each one of said elongated cylinder, wherein each of the elongated pistons defines a first end and a second end, wherein said first end of each of the elongated pistons is attached to the buoyant support structure proximal to a center of said lower surface of the buoyant support structure, wherein the elongated pistons are arrayed radially about the lower surface of the buoyant support structure, and wherein each of the undercarriage structures has a stored position and an extended position, and wherein each elongated cylinder is in slideable engagement with said second end of a one of the elongated pistons when the undercarriage structures are in said stored position, and wherein each one of the elongated cylinder is disengaged from the second end of a one of the elongated pistons and the undercarriage structures are disengaged from the buoyant support structure when the undercarriage structures are in said extended position, and wherein one of said elongated pistons and said elongated cylinder are moveable between the stored position and the extended position.

3. The deployable apparatus of claim 2, wherein the buoyant support structure defines a compartment and a means to introduce pressurized gas into the elongated cylinder adjacent to the second end of a one of the elongated pistons when the buoyant support structure is immersed in water, wherein said means to introduce said pressurized gas comprises:

one or more pressure vessels contained within said compartment, wherein said pressure vessels contain compressed air, a compressed air piping in fluid communication with said one or more pressure vessels and the elongated cylinder, a valve configured to control a flow of said compressed air within the compressed air piping from the one or more pressure vessels to the elongated cylinder, and a control system operably connected to said valve, wherein said control system is configured to instruct the valve to allow a flow of the compressed air from the one or more pressure vessels to said elongated cylinder only when the lower surface of the buoyant support structure is immersed in said water.

4. The deployable apparatus of claim 3, wherein the means to introduce the pressurized gas into said elongated cylinder further comprises:

a combustible charge contained within said elongated cylinder, and an electrical means for igniting said combustible charge, wherein said electrical means is operably connected to the control system for igniting the combustible charge.

5. The deployable apparatus of claim 3, wherein the control system comprises a floodable chamber defined by a chamber of said buoyant support structure, wherein said floodable chamber comprises a float switch and a conduction switch contained within the floodable chamber and operably connected to the valve, wherein said conduction switch is configured to detect a presence of water, and wherein the control system is configured to activate the valve only when said float switch and the conduction switch indicate a presence of water at the same time.

6. The deployable apparatus of claim 1, further comprising floating bulbs attached to upper distal ends of the buoyant longitudinal members for illuminating field of view of a rescue scene and of the persons and animals in said rescue scene.

7. The deployable apparatus of claim 1, further comprising a retractable cable connected to each of the buoyant longitudinal members for retracting said projected buoyant longitudinal members to the buoyant support structure.

8. The deployable apparatus of claim 7, wherein said retractable cable is wound around a pulley, wherein the retractable cable retracts the buoyant longitudinal members to the buoyant support structure using said pulley.

9. The deployable apparatus of claim 1, wherein each of the undercarriage structures comprises a framework enclosing a perforated casing.

10. The deployable apparatus of claim 1, wherein each of the undercarriage structures are powered by an outboard marine motor with a propeller system, and a guidance control system for allowing the undercarriage structures to be controlled and maneuvered in vicinity of a rescue scene for reaching persons and animals floating on a water surface.

11. The deployable apparatus of claim 1, wherein said loop extensions comprise a plurality of hook and loop fasteners for allowing the persons and animals to be rescued by securing their arms to the loop extensions.

12. The deployable apparatus of claim 1, further comprising a cable for suspending, lowering, and hauling the buoyant support structure, wherein said cable branches into a plurality of sub-cables, and wherein lower ends of said sub-cables attach to first hooks disposed on upper surface of the buoyant support structure.

13. The deployable apparatus of claim 1, wherein upper surface of the buoyant support structure is divided into a plurality of compartments.

14. The deployable apparatus of claim 13, further comprising a plurality of second hooks disposed along inner edges of said compartments.

15. The deployable apparatus of claim 1, further comprising a plurality of leg supports attached to the lower surface of the buoyant support structure for supporting the buoyant support structure.

16. The deployable apparatus of claim 1, further comprising a plurality of light bulbs disposed along perimeter of the buoyant support structure for illuminating field of view of a rescue scene and of the persons and animals in said rescue scene.

17. The deployable apparatus of claim 1, wherein said predefined shape is a circular shape.

18. A method of rescuing persons and animals, comprising the steps of:

providing a deployable apparatus comprising:

a buoyant support structure of a predefined shape, a plurality of rescue units detachably attached to said buoyant support structure for supporting said persons and animals, wherein said rescue units comprise one or more of:

a plurality of undercarriage structures positioned on lower surface of the buoyant support structure, wherein said undercarriage structures extend radially from said lower surface of the buoyant support structure on contacting a water surface, and wherein each of the undercarriage structures defines an elongated cylinder, and wherein the buoyant support structure defines a plurality of elongated pistons, wherein at least one of said elongated pistons corresponds to each one of said elongated cylinder, wherein each of the elongated pistons defines a first end and a second end, wherein said first end of each of the elongated pistons is attached to the buoyant support structure proximal to a center of the lower surface of the buoyant support structure, wherein the elongated pistons are arrayed radially about the lower surface of the buoyant support structure, and a plurality of buoyant longitudinal members detachably attached to upper surface of the buoyant support structure, wherein said buoyant longitudinal members project outwardly from the buoyant support structure in a projectile path towards the persons and animals to be rescued from the buoyant support structure, suspending the buoyant support structure with the rescue units from a height and lowering the buoyant support structure to said water surface using a cable, wherein said cable branches into a plurality of sub-cables for balancing the buoyant support structure, extending the undercarriage structures from the lower surface of said suspended buoyant support structure on contacting the water surface, wherein said extended undercarriage structures hold and secure the persons and animals rescued from the water, projecting the buoyant longitudinal members in said projectile path towards the persons and animals to be rescued, wherein the persons and animals secure to the projected buoyant longitudinal members, and retracting said projected buoyant longitudinal members to the buoyant support structure using a retractable cable connected to the buoyant longitudinal members, wherein said retraction draws said secured persons and animals to the buoyant support structure.

19. The method of claim 18, wherein said step of extending the undercarriage structures comprises disengaging the elongated cylinder in the undercarriage structures from said second end of a one of the elongated pistons, wherein said disengagement is caused by pressurized gas, wherein said pressurized gas causes the elongated cylinder to move with respect to the elongated piston.

20. The method of claim 18, further comprising the step of illuminating a field of view of a rescue scene and of the persons and animals in said rescue scene using a plurality of floating bulbs attached to upper distal ends of the buoyant longitudinal members, and a plurality of light bulbs disposed along perimeter of the buoyant support structure.

21. The method of claim 18, further comprising the step of enabling the persons and animals to grasp a plurality of loop extensions positioned along a cord disposed around perimeter of the buoyant support structure, wherein said loop extensions comprise a plurality of hook and loop fasteners for securing arms of the persons and animals, and further enabling the persons and animals to grasp a plurality of second hooks disposed along inner edges of a plurality of compartments of the buoyant support structure.

22. The method of claim 18, wherein said step of retracting the projected buoyant longitudinal members to the buoyant support structure is performed using a pulley, wherein said pulley retracts the projected buoyant longitudinal members to the buoyant support structure using said retractable cable.

23. The method of claim 18, further comprising the step of hauling the persons and animals secured to the rescue units of the buoyant support structure from the water surface using said cable for rescuing the persons and animals.

24. The method of claim 18, wherein each of the undercarriage structures comprises a framework enclosing a perforated casing, wherein said perforated casing is positioned at the water surface.

* * * * *